US010407203B2

(12) United States Patent
Adams et al.

(10) Patent No.: US 10,407,203 B2
(45) Date of Patent: Sep. 10, 2019

(54) MULTI BLOW MOLDED METALLIC CONTAINER

(71) Applicant: The Coca-Cola Company, Atlanta, GA (US)

(72) Inventors: John Adams, Alpharetta, GA (US); Rajesh Gopalaswamy, Alpharetta, GA (US); Simon Shi, Marietta, GA (US); Wen Zeng, Shanghai (CN)

(73) Assignee: THE COCA-COLA COMPANY, Atlanta, GA (US)

( * ) Notice: Subject to any disclaimer, the term of this patent is extended or adjusted under 35 U.S.C. 154(b) by 17 days.

(21) Appl. No.: 14/898,457

(22) PCT Filed: Jun. 16, 2014

(86) PCT No.: PCT/US2014/042581

§ 371 (c)(1),
(2) Date: Dec. 14, 2015

(87) PCT Pub. No.: WO2014/201473

PCT Pub. Date: Dec. 18, 2014

(65) Prior Publication Data

US 2016/0144991 A1 May 26, 2016

Related U.S. Application Data

(60) Provisional application No. 61/884,643, filed on Sep. 30, 2013, provisional application No. 61/835,397, filed on Jun. 14, 2013.

(51) Int. Cl.
*B21D 51/26* (2006.01)
*B65D 1/02* (2006.01)
(Continued)

(52) U.S. Cl.
CPC ..... *B65D 1/0284* (2013.01); *B21D 26/047* (2013.01); *B21D 26/049* (2013.01);
(Continued)

(58) Field of Classification Search
CPC .. B21D 26/033; B21D 26/035; B21D 26/041; B21D 26/045; B21D 26/047;
(Continued)

(56) References Cited

U.S. PATENT DOCUMENTS 2,044,710 A * 6/1936 Mantle ..... B21D 15/10 72/308
3,572,073 A * 3/1971 Dean ..... B21D 26/033 72/370.22
(Continued)

FOREIGN PATENT DOCUMENTS

EP 0439764 A2 8/1991
JP 8-267550 A * 10/1996 ..... B29C 49/08
JP 2007-537043 A 12/2007

OTHER PUBLICATIONS

International Search Report of International Application No. PCT/US2014/042581 dated Dec. 10, 2014, pp. 5.
(Continued)

*Primary Examiner* — Edward T Tolan

(57) ABSTRACT

A method of forming a shaped container may include providing a metallic preform. A first pressure may be applied to the metallic preform within a mold of a shaped container to produce a container part with a partially formed container shape. The container part with the partially formed container shape may then be at least partially annealed. A second pressure may be applied to the container part within the mold to produce a container part with a fully formed container shape.

13 Claims, 3 Drawing Sheets

(51) Int. Cl.
*B21D 26/047* (2011.01)
*B21D 26/049* (2011.01)

(52) U.S. Cl.
CPC ..... *B21D 51/26* (2013.01); *B65D 1/0223* (2013.01); *B21D 51/2607* (2013.01)

(58) Field of Classification Search
CPC .. B21D 26/049; B21D 51/26; B21D 51/2646; B21D 51/2607; B65D 1/0284
See application file for complete search history.

(56) References Cited

U.S. PATENT DOCUMENTS 3,896,648 A * 7/1975 Schertenleib ..... B21D 26/041 29/421.1
5,097,689 A * 3/1992 Pietrobon ..... B21D 26/043 29/421.1
5,203,190 A * 4/1993 Kramer ..... B21D 26/047 72/61
5,776,270 A 7/1998 Biondich
5,832,766 A * 11/1998 Hartman ..... B21D 51/2646 72/58
5,916,317 A 6/1999 Willoughby et al.
5,970,767 A * 10/1999 Hartman ..... B21D 51/2646 72/58
5,992,197 A * 11/1999 Freeman ..... B21D 26/033 29/421.1
6,067,831 A * 5/2000 Amborn ..... B21D 26/033 29/421.1
6,349,583 B1 * 2/2002 Kleinschmidt ..... B21D 26/041 29/421.1
8,899,085 B2 * 12/2014 Adams ..... B21D 26/049 72/370.22
9,321,093 B2 * 4/2016 Adams ..... B21D 26/049
9,849,501 B2 * 12/2017 Adams ..... B21D 51/2607
2003/0172512 A1 * 9/2003 Suarez ..... B21D 26/029 29/421.1
2004/0187536 A1 9/2004 Gong et al.
2005/0252263 A1 * 11/2005 MacEwen ..... B21D 26/033 72/55
2013/0167607 A1 7/2013 Adams et al.

OTHER PUBLICATIONS

Knecht, Frank; Extended European Search Report of EP Application No. 14810130.6 dated Sep. 6, 2017, pp. 1-8; European Patent Office, Munich, Germany.
Ogawa, Satoshi; Japanese Office Action for JP Application No. 2016-519713 dated Dec. 18, 2017, pp. 1-4; Japanese Patent Office, Tokyo, Japan.

* cited by examiner

MULTI BLOW MOLDED METALLIC CONTAINER

RELATED APPLICATIONS

This is the United States National Stage of Patent Cooperation Treaty Application No. PCT/US14/042581 filed in the U.S. Patent and Trademark Office on Jun. 16, 2014. The application claims priority to Patent Cooperation Treaty Application No. PCT/US14/042581, filed Jun. 16, 2014, which claims priority to U.S. Provisional Application Ser. No. 61/835,397, filed Jun. 14, 2013 and 61/884,643 filed Sep. 30, 2013; the contents of which are hereby incorporated herein by reference in their entirety.

BACKGROUND

Forming metallic containers, such as metallic containers used for consumer goods, and more particularly, metallic containers for consumer foods and beverages, has traditionally been performed by making conventional cans that are sealed with a lid. A variety of different lids have been used, including a sealed lid that requires a can opener to be opened and a sealed lid with a pull-tab that enables a user to peel open the lid. In both of these cases, the lid cannot be re-sealed.

More recently, metallic containers for beverages have been produced that are shaped in the form of a bottle. As an example, aluminum and steel bottles have been formed to resemble the shape of a beer bottle and sold at sporting events. These bottles are generally thick and are sealed with a crown cap, as understood in the art. Other metallic containers in the shape of bottles have been shaped to enable twist-off caps to be used.

Metallic containers that can be shaped in the form of a bottle offer several advantages over cans and glass bottles. First, metallic containers are more durable and do not shatter upon impact, such as dropping on a floor. Second, metallic containers are generally more lightweight than glass containers, thus costing less to ship and making it easier for vendors to carry. Third, metallic containers are less expensive than glass. Fourth, with respect to cans, metallic containers in the shape of bottles provide for easier gripping and offer the ability to marketers to provide more attractive containers to attract consumers.

While metallic containers in the shape of bottles ("metallic bottles") provide certain advantages over other container shapes, such as cans, and glass bottles, metallic bottles have heretofore been limited in the shapes that have been commercially feasible to produce. As an example, the number of steps that it currently takes to manufacture a shaped metallic bottle is generally over fifty. As a result, the amount of manufacturing equipment required is particularly high and production rates are particularly low. As another example, because metal, such as aluminum alloys or steel, when thinned has limited strength and has the tendency to bend or crinkle, forming thin metals to produce metallic bottles is challenging. Because of the tendency for thin metals to bend or crinkle, certain operations, such as die necking, are challenging and limits exist as to how much change in diameter can be made in a single step—historically not much more than 1%-2%. As understood in the art, it takes upwards of 350 lbs. or more of force to press a crown cap or twist-off cap onto a metallic bottle. As a result of the strength issues and capping force requirements, the thickness of the metallic bottles, especially at the neck and finish of the metallic bottle, has traditionally been high. While higher thickness of metals results in stronger bottles, the higher thickness limits the ability to shape intricate details in the metallic bottles and results in heavier metallic bottles. The heavier bottle adds to manufacturing and shipping costs, for example. As such, there is a need to use an alternative technique to manufacture metallic bottles to overcome thin metal limitations.

In addition to forming the metallic bottles, decorating metallic bottles by shaping or applying features to the sidewall of the metallic bottle is processing intensive as multiple steps are generally used to shape or apply features to the sidewall. A conventional process for shaping and applying features to the sidewall includes pressing metal to apply the desired shape or features to the sidewall while flat prior to the sidewall being formed into a metallic bottle shape. Such a conventional process provides limited possibilities, as understood in the art.

SUMMARY

The principles of the present invention provide for performing multiple blow molding operations to metal to produce shaped metal containers, such as metallic bottles. The metal may start as a metal preform composed of aluminum, such as aluminum alloys or steel. Because metal has a maximum strain beyond which the metal ruptures or fails (e.g., tears), a first pressure, such as pneumatic or hydraulic force, may be applied to the metal preform to cause the metal preform to reach a certain strain, and then at least a portion of the metal preform may be at least partially annealed, thereby causing a stress release in the metal. After the stress of the metal has been released, a second force, such as pneumatic or hydraulic force, may be applied to cause any portion of the metal preform that has not reached its final position within a mold to stretch to continue moving toward or reach a final position in the mold. As a result of using multiple blow molding operations, metallic bottles can be shaped in ways that have heretofore been impossible or commercially difficult to achieve.

One embodiment of a method of forming a shaped container may include providing a metallic preform. A first pressure may be applied to the metallic preform within a mold of a shaped container to produce a container part with a partially formed container shape. The container part may be at least partially annealed with the partially formed container shape. A second pressure may be applied to the container part within the mold to produce a container part with a fully formed container shape.

One embodiment of a metal vessel may include a metallic open end defining an upper portion of a cavity of the metal vessel, and be configured to receive a cap. A metallic closed end may be opposed to the open end, and define a lower portion of the cavity of the metal vessel. The closed end may include multiple, integrally formed feet that, in part, define the lower portion of the cavity.

One embodiment of a metal vessel may include a metallic open end, a metallic closed end opposed to the metallic open end, and a metallic sidewall portion extending between the metallic open end and the metallic closed end. The metallic closed end may include a base portion on which the metal vessel stands and having a grain structure that is integral with a grain structure of the sidewall portion.

One embodiment of a method of forming a metal container with a featured sidewall may include providing a blow molded metal container. The metal container may be positioned into a mold inclusive of at least one sidewall feature. The metal container may be blown again to cause the at least one sidewall feature to be created in the sidewall of the container as defined by the mold. In one embodiment, a sidewall of the metal container may be at least partially annealed. The sidewall feature may include a portion of a profile of a sporting good, such as a baseball, embossed feature (e.g., word), logo, or otherwise. The metal container may be a shaped metal container. The metal container may be a partially or fully formed metal container.

One embodiment of a system for forming a metal container with a featured sidewall may include providing a mold inclusive of at least one sidewall feature adapted to receive a blow molded metal container with the at least partially annealed sidewall. A blowing mechanism may be configured to blow the metal container again to cause the at least one sidewall feature to be created in the sidewall of the container as defined by the mold. The metal container may be a partially or fully formed metal container.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION

Multi-Blow Molding Containers

Figure 1:
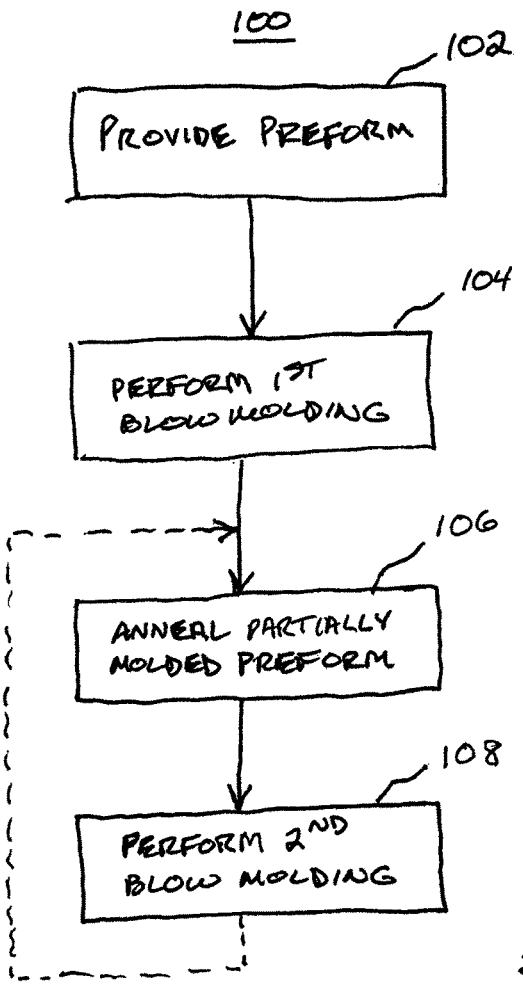
FIG. 1 is a flow diagram of an illustrative process for multi-blow molding a metallic vessel.

With regard to FIG. 1, a flow diagram of an illustrative process 100 for multi-blow molding a metallic vessel is shown. The metallic vessel may be in the shape of a bottle or any other container, as understood in the art. Because certain container shapes have dimensions that are difficult to manufacture using standard metal working techniques, the principles of the present invention may alleviate extensive manufacturing processes that allow for shaping metallic vessels with such dimensions. As an example, many plastic bottles include feet that define a cavity within the plastic bottle. These feet, however, are difficult or not possible to form using conventional metal manufacturing processes because the dimensions are beyond deformation of thin metals during a conventional blow molding or other metal shaping processes.

The process 100 starts at step 102, where a metallic preform ("preform") may be provided. The metallic preform may include a variety of different metallic compositions, including aluminum or steel. In one embodiment, an aluminum preform is composed of aluminum alloy. The aluminum alloy may be a 3000 series aluminum alloy, and more specifically, but not by way of limitation, the aluminum alloy may be a 3104 series aluminum alloy. In providing the metallic preform, it is contemplated that the metallic preform may be provided by setting the metallic preform along a manufacturing line to be shaped into a metallic container, such as a bottle shaped container. Manufacturing of the metallic preform may be performed by a third-party, such as a metallic preform manufacturer, such that a bottler may receive and provide the metallic preform to the manufacturing line. In an alternative embodiment, a bottler may receive a blank roll of metal, such as aluminum, and create a metallic preform from that blank sheet to provide the metallic preform to the manufacturing line.

The metallic preform may have any of a number of different shapes. For example, the preform may be tubular in the shape of a cup or cylinder (i.e., having sidewalls and bottom). The intersection between the sidewalls and bottom may be squared off (i.e., 90 degrees) or be curved. Alternative intersection designs may be utilized in accordance with the principles of the present invention. In one embodiment, the metallic preform may have a test-tube shape or miniature bottle shape with an open end and a closed end. If the metallic preform is to be limited to a portion of an overall container (e.g., a container part) as opposed to ultimately defining an entire container, then the metallic preform may be limited in shape and size.

In addition to the preform having a certain shape, the preform may have a variety of different thickness dimensions. In one embodiment, the thickness dimensions are substantially equal along the entire preform. Alternatively, a bottom portion may be thicker if expansion along the axial plane may be used to form feet, for example. In one embodiment, if an upper portion of the preform is to be shaped to be a conventional closure, an upper portion of the preform may be thicker than the sidewalls. In one embodiment, the upper portion and bottom portions of the preform may be thicker than the sidewalls. In manufacturing the preform, the shaping may be formed with a substantially constant thickness and portions, such as the sidewalls, of the preform may be thinned or a shaped preform (i.e., certain portions thicker and thinner when manufactured). The thickness distribution along the length of the preform plays a role in the end shape and material distribution of the container, and may be manipulated or pre-configured to optimize the process (i) to minimize the weight of the preform and ultimately the container and/or (ii) to maximize the performance of the final shaped container.

At step 104, a first blow molding of the preform may be performed. The first blow molding may use 40 Bar or more to blow the metal. The blow molding may use pneumatic or hydraulic pressure blow molding. In one embodiment, the fluid of the blow molding may be at a temperature above room temperature, such as 200 degrees Celsius or higher. Lower pressures may be used to blow the metallic preforms as well. Because thin metals are limited in deformation due to strain limitations (i.e., an amount of strain or elongation of which a metal can withstand before fracture), the strain resulting in deformation of the preform may cause the sidewalls to extend to contact mold walls within which the preform is positioned, while other portions of the preform, such as feet, that cannot be fully formed without fracture cannot reach the mold walls as a result of the first blow molding at step 104.

At step 106, the blow molded preform may be (i) locally or entirely and (ii) partially or fully annealed. That is, a portion (e.g., base or lower portion) of the blow molded preform or the entire blow molded preform may be annealed. As understood in the art, annealing causes stress in the metal to be "reset" or brought back to an initial stress-relieved state (also known as stress relaxation). That is, the grains of the metal that have been deformed (i.e., stretched or reshaped) and stressed are reset to an initial zero stress or stress relieved state. Partially annealing causes stress in the metal to be brought to a lower stress-relieved state, but not fully stress-relieved to an initial state. By at least partially annealing to reset the stress of the blow molded preform, another blow molding can be performed that lowers the risk of a subsequent blow molding from over-stressing the metal to cause the metal to fail. In one embodiment, rather than fully annealing the entire preform or localized portion of the preform, the annealing performed at step 106 may reduce the stress to a level that accommodates further desired deformation, but is not zero stress. For example, the preform may be partially annealed or normalized, both of which are considered equivalent in function. By providing for a partial annealing, time and energy may be reduced in the manufacturing process, thereby saving cost and improving production rate. In some cases, depending on the final container geometry desired, annealing prior to a subsequent (e.g., second) blow molding may not be necessary if the amount of strain that the metal will undergo in the subsequent blow molding process will be less than a strain that will cause the metal to fracture or otherwise deform.

At step 108, a second blow molding may be performed to the blow molded preform after the annealing process. The second blow molding 108 may cause portions of the blow molded preform to further deform to extend to the mold walls in which the blow molded preform resides. As an example, feet of a bottle that cannot be fully formed during the first blow molding at step 104 may be further deformed to reach the mold walls defining feet during the second blow molding 108. Because it may not be possible for two blows to cause the preform to fully deform to reach the mold walls, steps 106 and 108 may be repeated multiple times until the preform is fully molded. It should be understood, however, that the number of anneals and blows at steps 106 and 108 may be limited to the amount of stretch possible for the preform, which may be defined by the thickness of the metal, metal type, amount of annealing, and so on. In one embodiment, the fully shaped preform (e.g., bottle shape) may be left in whatever strain-hardened condition it is in after the second blow molding at step 108. Alternatively, the fully shaped preform, or portion thereof, may be fully or partially annealed to reset the metal to a less stressed state. Being in a strain-hardened state, however, may allow the container to be more durable for manufacturing, shipping, and consumer use. There may be commercial reasons for having the container be somewhat more pliable, so partial or full annealing may be performed after the container is fully shaped.

Figure 2:
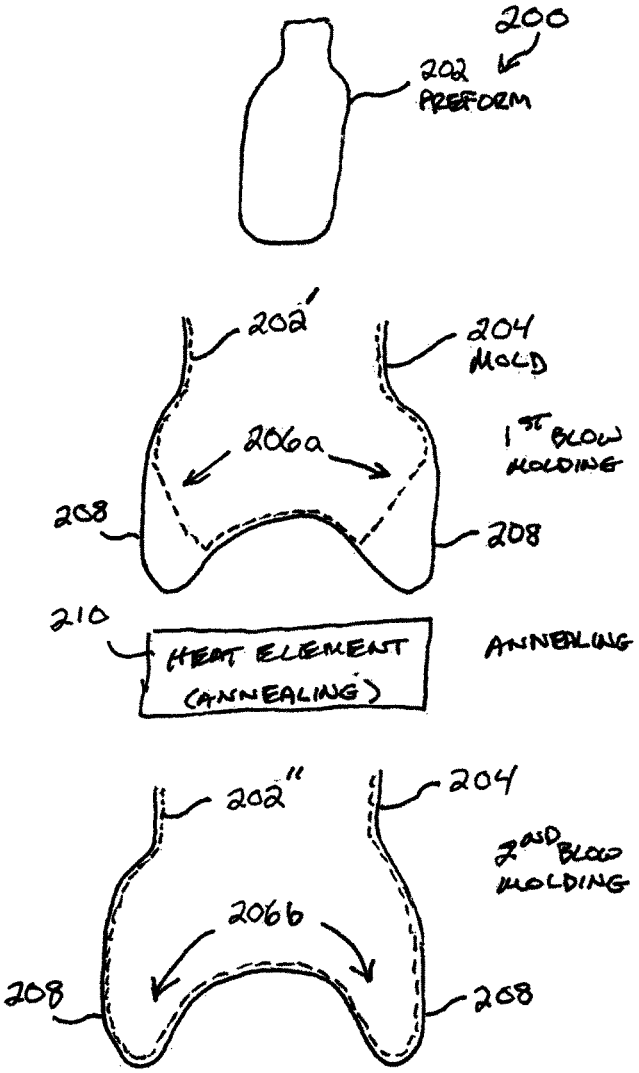
FIG. 2 is a process diagram of an illustrative process for multi-blow molding a metalling vessel corresponding with the process of FIG. 1.

FIG. 2 is a process diagram of an illustrative process 200 for multi-blow molding a metallic bottle corresponding with the process 100 of FIG. 1. The process 200 may start by providing a preform 202. A mold 204, which may be formed of single or multiple segments, may be provided. As understood in the art, the preform 202 may be disposed within the mold 204, to be blown. As previously described, in blowing the preform, pressure, such as 40 Bar or higher, may be applied within the preform to cause the preform to strain and deform. As a result of the deformation, the metal may be strain-hardened ("hardened"), as understood in the art. As shown, the preform 202 may result in a partially molded preform 202' that contacts certain portions of the mold (e.g., sidewalls), while other portions of the preform **206*a* do not contact other portions of the mold 208**, which, in this case, are feet of a bottle mold. Other shapes, such as single or concentric rings, at the base may be produced using the multi-blow molding process described herein.

A heat element 210, which may be an oven, heating element, open flame, or other heat source, may be used to perform whole or localized annealing, either fully or partially annealed, of the partially molded preform 202'. If a localized annealing process of the partially molded preform 202' is performed, then portions of the partially molded preform 202' remain in a strain-hardened state, while the annealed portions of the partially molded preform 202' are partially or entirely stress relieved and available for further blowing and deformation.

Continuing with FIG. 2, a second blow molding may be performed on the partially molded preform 202' to cause the partially molded preform 202' to continue being deformed. As shown, portions **206*b* of the partially molded preform 202' that were not fully deformed may be fully deformed so as to contact the other portions of the mold 208. As described with regard to FIG. 1, the process 200 may provide for multiple blow molding and annealing processes to fully deform the preform 202 into a fully molded preform 202". That is, the second blow molding may actually be a third or forth blow molding with intermittent annealing processes to at least partially reset the stress of the metal of the partially molded preform 202'**.

Because the feet may be formed in a second or higher blow molding process, the portions **206*b* defining the feet may use a higher strain than other portions of the container, such as the sidewalls, which may extend to the mold 204 in a first or fewer blows. And, if the entire preform 202, which is being shaped into a container part, which may include being an entire container, is annealed between blows, the portions 206*b* will have a higher strain-hardness than other portions of the fully molded preform 202". If an annealing process is performed between blow moldings, such as annealing the portions 206*a* that are being shaped into feet, then the blow molding process may strain-harden the portions 206*b* to a higher level than other portions of the fully molded preform 202". And, because the axial depth of the portions 206*b* are greater than other portions of the fully molded preform 202", such as the radially shaped sidewalls or open end, deformation of the portions 206*b* are higher than deformations of the other portions of the fully molded preform 202"**.

Figure 3:
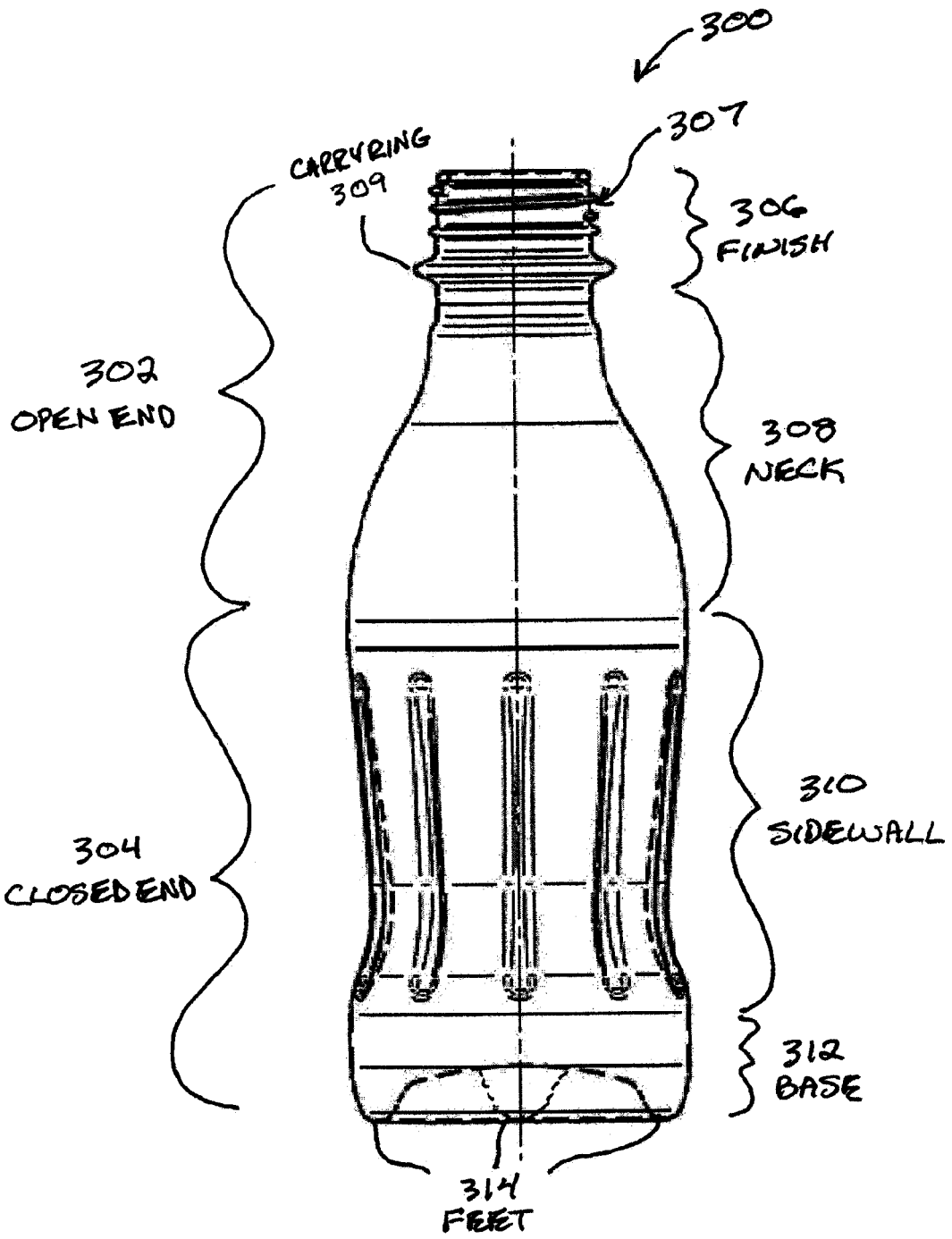
FIG. 3 is an illustration of an illustrative container shaped as a bottle inclusive of defined portions, as described herein.

With regard to FIG. 3, an illustration of an illustrative metallic container 300 shaped as a bottle inclusive of defined portions, as described herein, is shown. The container 300 includes an open end 302 and closed end 304. The open end 302 and closed end 304 are shown to be divided along a tapering portion of the container 300. It should be understood, however, that the open and closed ends 302 and 304 may have an alternative location along the container 300 at which each starts and stops. In accordance with the principles of the present invention, a preform may be configured to be formed into one, both, or a subsection of one of the open end 302 and closed end 304.

The open end 302 may include a finish region 306 that generally includes a threaded portion 307 and may or may not include carry ring 309, which is used during manufacturing of the container 300. A neck portion or neck 308 may be a tapering section extending from a sidewall portion or sidewall 310 to the finish portion 306. The sidewall portion may also be considered to include the neck portion 308. A base portion or base 312 may be a bottom portion of the container 300 on which the container rests. The base portion 312 may include multiple feet 314, such as, for example, at least two feet 314 that may, in part, define a cavity of the container 300 in which a beverage is stored. Further, the feet 314 may have any shape, such as, for example, individual external protrusions disposed about the circumference of the base 312 and/or rings concentrically disposed about one another and protruding from or defining, in part, the base 312.

As shown, a profile of the sidewall portion 310 is shown to be shaped. Because the sidewalls have limited variance (e.g., a waist), the blow molding process of FIG. 1 may accommodate for the shaping of the sidewall portion 310 in a single blow, where the feet 314, which are larger protrusions, may need two or more blow molds with intermittent annealing, either full or partial annealing, to enable the preform metal to extend to fully form the feet 314. A cap (not shown), which may be metal or plastic, may be used to seal the container with fluid therein, as understood in the art.

Referring back to FIG. 2, because the metallic preform 202 may be used to shape the portions 206*b* (i.e., feet 314) along with other portions of the fully molded preform 202", such as the base 312, sidewall 310, neck 308, and finish 306, a grain structure of the metal may extend between the open end 302 and closed end 304. In one embodiment, a container part may include feet 314 and base 312, where the base 312 may extend or be attached to the sidewall 310. In one embodiment, the container part is inclusive of an entire container with the exception of a cap as capable of being produced by a metal preform inclusive of a finish with or without threads, as understood in the art. Metallic grain structures may extend between the feet 314 and base 312 inclusive of a portion of sidewall above the feet 314. That is, the grain structures may extend and be continuous between multiple portions of the container 300 (e.g., neck and sidewalls, sidewalls and base and/or feet). The feet 314, thus, may have an integral and continuous grain structure with the base 312 and/or the sidewall 310 of the container 300. And, as a result, the feet 314 are integral with the closed end 304 and define cavity within the container 300. Although the base 312 is shown as having feet 314, it should be understood that alternative shapes and configurations may be formed using the multi-blow molding process described herein.

Multi-Blowing Sidewall Features into Containers

In addition to the principles of the present invention providing for producing blow molded metallic containers, such as bottles, that are thin and have features that are not part of the general shape of the containers. In one embodiment, the features may extend beyond features that are possible to create from a single blow due to the metal extending beyond a strain limit. For example, utilizing the principles of the present invention, three-dimensional (3D) designs, such as sports items, logos, cartoon characters, etc., may be created in the sidewalls. Furthermore, the principles of the present invention provide for producing containers with high resolution sidewall features, such as embossing or other decoration style or feature. As with the previously described multiple blows separated by at least a partial annealing process therebetween to at least partially stress relieve metal, multiple blows separated by at least partially annealing the sidewalls, may be utilized. Such a multiple blow molding process may enable a feature, such as embossing, to be added to the sidewalls of the container. In one embodiment, the annealing may be localized in a limited region of the sidewall or the entire sidewall may be annealed (or partially annealed). The amount of annealing may vary from zero to a full stress-relieved metal depending on an amount of strain that exists in the previously blown sidewall, expansion of the sidewall to form the feature(s), detail in the feature(s), and so on.

For the purposes of this application, a "feature" created through a secondary blow molding process (i.e., either a second or later blow molding of at least a portion of a container) and applied to a sidewall of a container. A feature may be any geometrical, material or process related feature where the sidewall of the container is either deformed or formed from the previous stage of forming that the container has gone through, or in the case of a mold where it is subjected to forces and deforms permanently to conform partially or fully to the mold surface. Therefore, any geometrical, material attachment or process treatment that makes part of or the entire sidewall to undergo any permanent deformation compared to the previous shape and form of the container sidewall can be considered a feature on the sidewall.

Figure 4:
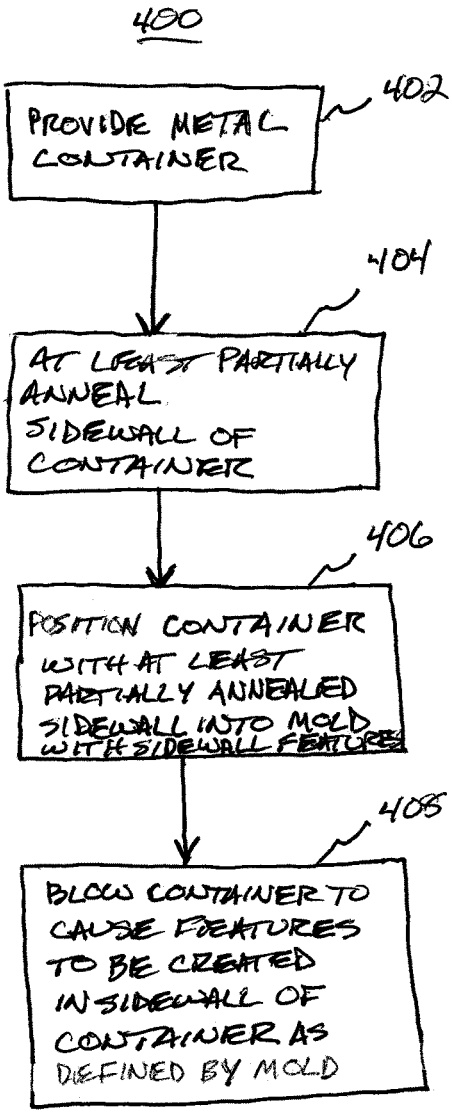
FIG. 4 is a flow diagram of an illustrative process for creating features in a sidewall of a container using a multiple blow molding process.

With regard to FIG. 4, a flow diagram of an illustrative process 400 for creating features in a sidewall of a container using a multiple blow molding process is shown. The process 400 may start at step 402, where a metal container may be provided. The metal container may be aluminum, steel, or any other thin metal that may be used for a beverage container, as previously described herein. Although the principles of the present invention provide for the metal container to have been previously blow molded to be a "blank" metal container (i.e., a container without any sidewall features), non-blow molded metal containers may also be utilized in accordance with the principles of the present invention. At step 404, a sidewall of the metal container may be at least partially annealed. In at least partially annealing the sidewall, the sidewall may be heated, either locally (i.e., a portion of the side wall) or entirely (i.e., the entire sidewall may be heated), to cause the sidewall to be respectively stress relieved partially (i.e., to remain above a zero stress state) or entirely (i.e., to a zero stress state).

At step 406, the container with the at least partially annealed sidewall may be positioned into a mold with a sidewall feature. The mold may be a multi-segment mold (e.g., three segments, including two sidewall forming segments and one base forming segment). In one embodiment, the mold with the sidewall feature may the same or different mold than a mold used to originally form the "blank" container. If the same mold, then the features of the sidewalls may not have been fully formed in the initial blow process due to feature shape, resolution, or distance from center of the container. The container may be a portion or complete container. Positioning of the container within the mold may be performed automatically, as understood in the art.

The mold may be sized substantially the same as a mold, if different, from the mold that formed at least a portion of the container (e.g., portion of the container below a finish (i.e., top portion of a bottle that includes the threads)), with the exception of a feature defining portion of the mold used to form a feature in the container. In one embodiment, the feature defining portion may protrude outward from the mold, where an inside wall of the mold protrudes from the surrounding portion of the inside wall of the mold that is shaped to otherwise substantially match the container. In another embodiment, the feature defining feature may extend inward from the surrounding portion of the inside wall of the mold that is shaped to otherwise substantially match the container. If an inward defining feature is utilized, a low, pre-pressure may be applied to the container prior to contacting the mold to the container, thereby minimizing chances of the container being deformed as a result of the contact prior to applying a higher pressure (step 408) to cause the inward feature to be formed in the container. In one embodiment, the pre-pressure may be 5 Bar or less, and the higher pressure may be 40 Bar or higher. Alternatively, low and high pressures may be utilized in accordance with the principles of the present invention.

At step 408, the container may be blown to cause features to be created in the side wall of the container as defined by the mold. In being blown, and as described above, higher pressure, such as 40 Bar, may be applied to the mold and container. The pressure applied to the container may be applied using a step function, where the pressure ramps from a first pressure level to a second pressure level in a short period of time (e.g., less than 0.25 seconds). As a result of blowing the container at the higher pressure, the sidewalls of the container may be expanded to be formed by the features of the mold. And, because the sidewalls of the container have been at least partially annealed, the sidewall portions that are altered to be formed into features may be hardened from their softened state as a result of being annealed. Hence, the features may end up having different hardness than surrounding portions of the sidewall that were not altered by the features defined by the mold. It should be understood that because the features of the sidewall may have different distances extending from or into the sidewall, that the hardness of the features, too, may vary depending how much stretching or deformation occurs from a feature being formed in the sidewall of the container. For example, in the case of a portion of a baseball feature with stitching features being formed from a sidewall of an aluminum bottle, a portion of the baseball feature that is farthest from the cylindrical shape of the sidewall (or center of the bottle itself) has the most stretch, and is therefore the most strain-hardened, while the portion of the baseball feature that is closest to the cylindrical shape of the sidewall is less strain-hardened as a result of having the least stretch from the feature forming process. Moreover, the stitching features that are part of the baseball feature may have a different hardness than the spherical portion of the baseball feature as a result of extending from the spherical portion and having details formed by small deformations.

Figure 5:
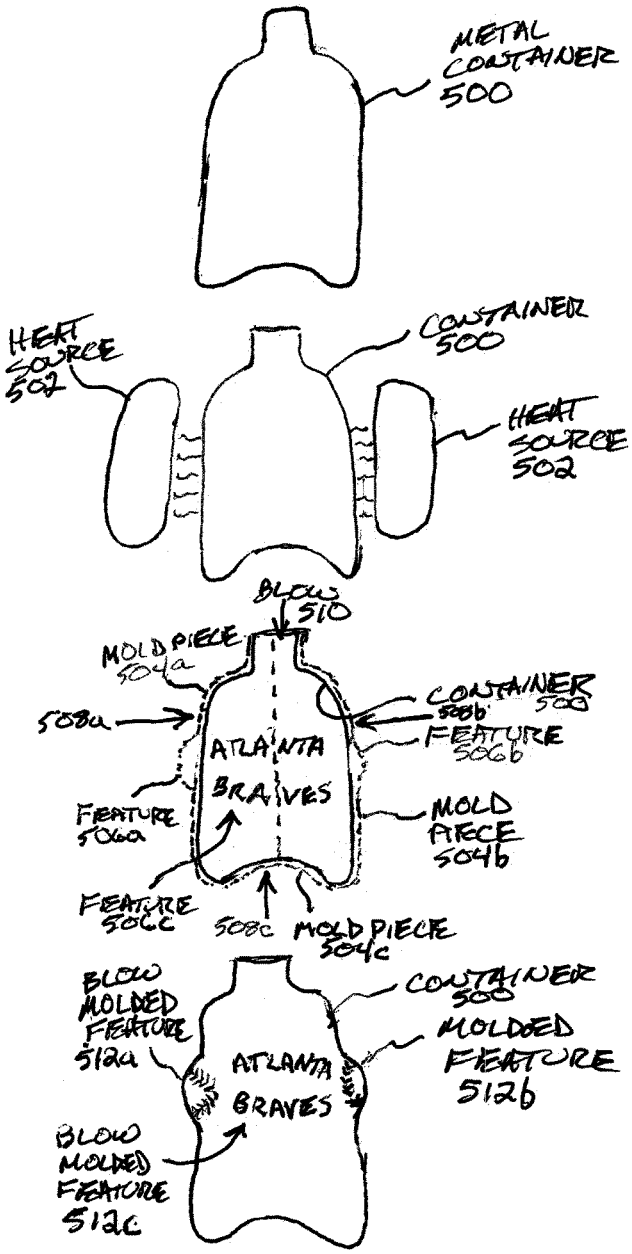
FIG. 5 is an illustration of an illustrative multiple blow molding process for creating features is a sidewall of a container.

With regard to FIG. 5, an illustration of an illustrative multiple blow molding process that corresponds to the process 400 of FIG. 4 for creating features in a sidewall of a metal container 500 is shown. The process may provide the metal container 500. The metal container 500 may be a whole container or a portion of a container (e.g., lower portion inclusive of a base). The container may be positioned near a heat source 502 that includes one or more heating elements. In positioning, the heat source 502 may be moved to be in proximate location to the container 500 or the container 500 may be moved to be in proximate location to the heat source 502. The heat source 502 may heat a local region or entire sidewall of the metal container 500 to at least partially anneal the sidewall. In an alternative embodiment, if the sidewall is not expanded to a failure point, then the sidewall can be blown further without fracturing the sidewall when forming a feature in the sidewall. It should be understood that the depth of the feature to be created on the sidewall may be used to determine whether or not the sidewall can be blown without causing failure of the sidewall by blowing a second time without at least partially annealing the sidewall (or may be used to determine how much annealing is to be performed).

A mold includes multiple mold pieces or segments 504*a*, 504*b*, and 504*c* (collectively 504) that include three mold features 506*a* (baseball half), 506*b* (baseball half), and 506*c* (embossed words) (collectively 506). It should be understood that the number of features may be one or more. The mold pieces 504 may form a complete mold when the mold pieces 504 are moved together using motions 508*a*, 508*b*, and 508*c* (collectively 508) using any electromechanical, hydraulic, pneumatic, or other process, as understood in the art. The complete mold may have substantially identical dimensions as the mold that created the container (i.e., length, width, and profile that does not allow the container to deform in any region other than the feature region(s). In one embodiment, the mold may be the same mold that created the container. However, by using a separate mold (i.e., one without features and one with features), "blank" containers may be formed that can thereafter have feature(s) applied thereto, and those feature(s) may be different for different purposes. The different purposes may include different events (e.g., baseball, football, auto racing, Olympic games, college events, etc.) or any other purpose (e.g., company logos, college logos, city memorabilia, cartoon characters, etc.). Moreover, small numbers of metallic containers with specific features may be produced from "blank" containers in an affordable manner and in a dynamic manner through use of a dynamic manufacturing system with one or more blow molding stations. In one embodiment, rather than using fixed molds, pixelated, dynamically configurable molds may be utilized that allow for three-dimensional (3D) features to be dynamically created to form the features.

After the mold is formed and positioned around the container 500, the container 500 may be blown 510 using a blowing mechanism, as understood in the art, via an opening in the container to cause a pressure, such as 40 Bar or higher, to force the sidewalls to expand into the features 506 of the mold. Resulting from the blow, molded features 512*a*, 512*b*, and 512*c* are created in the sidewall of the metal container 500. Depending on the resolution of the features to be created in the sidewall, the amount of pressure, amount of annealing, and/or other factors may be adjusted to accommodate the desired resolution, where the resolution includes intricacies or detail of the features. More specifically, as the metal is blown a first time, as the metal is stretched, it becomes strain-hardened, which may limit the ability for the metal to be shaped to have high resolution of a feature. As such, by at least partially annealing the metal, the metal can be better shaped to be formed with high resolution features. As an example, general shape of a football feature is considered low resolution, while stitching in the football is considered higher resolution. A team mascot, such as an eagle, may also have high resolution features (e.g., feathers, fur, eyes, etc.). Other features with different resolutions are possible. It should be understood that any feature shape that can be created in a mold and that the sidewall can withstand being formed into the feature without rupturing may be utilized in accordance with the principles of the present invention.

Blow molding a metal preform to create at least a portion of a metal container is one technique for producing a shaped metal container with sidewalls with features. Another technique for creating a shaped metal container with sidewall features may alternatively include starting with a straight wall cylinder formed using blow molding or fabrication techniques that do not use include blow molding. As such, cans or other shaped metal containers may utilize the multiple blow molding principles of the present invention to create metal containers with sidewalls inclusive of features.

One embodiment of a method of forming a container with a featured sidewall may include providing a blow molded metal container. The metal container may be positioned into a mold inclusive of at least one sidewall feature. The metal container may be blown again to cause the sidewall feature(s) to be created in the sidewall of the container as defined by the mold. The metal container may be a partially formed metal container or fully formed container. The process may further include partially or fully annealing a sidewall of the metal container. In annealing, either partially or fully, the sidewall may be heated to a temperature that causes metal grains of the sidewall transition to a reduced stress state from an existing stress state. In annealing the sidewalls, either partially or fully, a localized portion of the sidewall may be heated. Positioning the metal container in the mold may include moving multiple mold pieces about the metal container, where the mold pieces, when integrated or in contact with one another, have a profile that substantially matches a profile of the container with the exception of the sidewall feature(s) of the mold. In one embodiment, the sidewall feature(s) include a portion of a profile of a sporting good. In one embodiment, a sidewall feature may include an embossed feature, such as a word or otherwise. The metal of the sidewall feature(s) has a different hardness than metal surrounding the sidewall feature(s). In providing a metal container, a shaped metal container may be in a shape of a bottle.

One embodiment of a system for forming a metal container with a featured sidewall may include a mold inclusive of at least one sidewall feature, and adapted to receive a blow molded metal container. A blowing mechanism may be configured to blow the metal container again to cause the sidewall feature(s) to be created in the sidewall of the metal container as defined by the mold. The metal container may be a partially formed metal container or a fully formed container. The system may further include a heater configured to at least partially anneal the sidewall of the metal container. Moreover, the heater may be configured to at least partially anneal the sidewall to a temperature that causes metal grains of the sidewall to transition to a reduced stress state from an existing stress state. In one embodiment, the at least partially annealed sidewalls may heat a localized portion of the sidewall. The mold may include multiple mold pieces configured to be formed about the metal container, where the mold pieces, when integrated or in contact with one another, have a profile that substantially matches a profile of the container with the exception of the sidewall feature(s) of the mold. The sidewall feature(s) may include a portion of a profile of a sporting good. The sidewall feature(s) may include an embossed feature, such as a word. The sidewall features may have different resolutions (e.g., low and high, including high resolution features extending from low resolution features). Metal of the at least one sidewall feature may have a different hardness than metal surrounding the at least one sidewall feature. In one embodiment, the metal container may be in the shape of a bottle.

The previous detailed description is of a small number of embodiments for implementing the invention and is not intended to be limiting in scope. One of skill in this art will immediately envisage the methods and variations used to implement this invention in other areas than those described in detail. The following claims set forth a number of the embodiments of the invention disclosed with greater particularity.

What is claimed:

1. A method of forming a shaped container, comprising:

providing a metallic preform having an open end, a sidewall portion and a closed end, wherein a wall thickness of the preform is thicker at the closed end than in the sidewall portion;

applying a first pressure to the metallic preform within a mold of a shaped container to produce a container part with a partially formed container shape having an open end and a closed end;

performing localized partial annealing of the container part with the partially formed container shape by at least partially annealing the closed end of the container part with the partially formed container shape; and applying a second pressure to the container part with the partially formed container shape within the mold to outwardly deform the closed end of the container part with the partially formed container shape to at least partially produce a plurality of integrally formed feet in the closed end of the container part with the partially formed container shape, wherein the plurality of integrally formed feet are configured to form at least a portion of a base of the shaped container.

2. The method according to claim 1, wherein applying the first pressure includes applying a pneumatic or hydraulic pressure to the preform.

3. The method according to claim 2, where applying a pneumatic or hydraulic pressure to the preform includes applying a pneumatic or hydraulic pressure with a fluid at a temperature above room temperature.

4. The method according to claim 1, further comprising heating the metallic preform above room temperature prior to applying the first pressure.

5. The method according to claim 1, further comprising:

at least partially second annealing after applying the second pressure; and applying a third pressure to the container part within the mold to produce the container part with the fully formed container shape.

6. The method according to claim 1, wherein applying a first pressure includes applying a pressure of at least about 40 Bar.

7. The method according to claim 1, further comprising:

applying at least one third pressure to the container part; and performing at least one corresponding at least partially second annealing to the metallic preform prior to applying the at least one third pressure.

8. The method according to claim 1, wherein applying the second pressure includes applying a pneumatic or hydraulic pressure to an inside of the container part.

9. The method according to claim 1, wherein providing a metallic preform includes providing a metallic preform composed of aluminum or steel.

10. The method according to claim 1, wherein applying the second pressure comprises applying the second pressure using a step function.

11. The method according to claim 10, wherein the second pressure is reached in less than 0.25 seconds.

12. The method according to claim 1, wherein providing a metallic preform comprises providing an aluminum preform.

13. The method according to claim 1, wherein providing a metallic preform comprises providing a preform with varying wall thicknesses configured to one or more of:

minimize a weight of the preform;

maximize a performance of the shaped container.

* * * * *